United States Patent [19]

Van Bragt

[11] 4,002,939

[45] Jan. 11, 1977

[54] ELECTRIC LAMP

[75] Inventor: Johannes Maria Van Bragt, Eindhoven, Netherlands

[73] Assignee: U. S. Philips Corporation, New York, N.Y.

[22] Filed: Mar. 3, 1976

[21] Appl. No.: 663,487

[30] Foreign Application Priority Data

Apr. 1, 1975 Netherlands ..... 7503829

[52] U.S. Cl. ..... 313/217; 313/332

[51] Int. Cl.[2] ..... H01J 61/06

[58] Field of Search ..... 313/217, 331, 332; 174/50.64

[56] References Cited

FOREIGN PATENTS OR APPLICATIONS 580,276 9/1946 United Kingdom

*Primary Examiner*—R. V. Rolinec
*Assistant Examiner*—Darwin R. Hostetter
*Attorney, Agent, or Firm*—Frank R. Trifari; Robert S. Smith

[57] ABSTRACT

Electric lamps according to the invention have inner current conductors with a molybdenum part which is welded to the molybdenum foil in the pinch of the quartz glass lamp vessel and a tungsten part which supports the electrode or the filament and is connected to the molybdenum part by a butt weld.

As a result of this construction reject and production disturbances upon making the welded joint between the molybdenum foil and the inner current conductor which occur when tungsten current conductors are used are avoided.

3 Claims, 3 Drawing Figures

ELECTRIC LAMP

The invention relates to an electric lamp having a quartz glass lamp vessel with gas filling and pinched seal, in which seal a molybdenum foil is incorporated to which an outer current conductor and an inner current conductor are welded.

Such lamps are generally known. The inner current conductor is a rod which consists mainly of tungsten, for example, tungsten with a few per cent of thorium.

The welded joint between the molybdenum foil and the comparatively thick inner current conductor repeatedly gives rise to interruption of the production process and rejects, in particular when high-speed production machines are used. Not only does the tungsten welding electrode stick repeatedly to the molybdenum foil upon making the weld, the foil has also become so brittle at the weld, since welding has to be carried out with high powers, that fracture easily occurs upon assembling the lamp. These disturbances are also the result of the large difference in melting temperatures between tungsten (3400° C) and molybdenum (2600° C).

These problems could be prevented by using an inner current conductor of molybdenum, but in that case sputtering or evaporation of molybdenum occurs during operation, which results in blackening of the wall of the lamp vessel and hence a reduced light output.

Another possibility of removing the welding problems might consist of using a platinum foil between the molybdenum foil and the inner current conductor. Providing such a foil at the place of the weld, however, is not very suitable for a mechanised production process so that it provides no solution which is suitable in practice.

It is the object of the invention to avoid the described drawbacks and to provide a lamp construction which is suitable for a mechanised production.

In agreement herewith, the invention relates to an electric lamp of the kind mentioned in the preamble which is characterized in that the inner current conductor, at least at the area of the welded joint to the molybdenum foil, consists of a molybdenum part which is connected by means of a butt weld to a part which mainly consists of tungsten and extends further in the lamp envelope.

It is to be noted that the construction described in British Patent Specification No. 580,276 does not meet the objects of the invention. According to this Patent Specification, the two ends of the molybdenum foil are wrapped in molybdenum foil of a larger thickness. The external and internal current conductors are welded to said wrapped ends.

Although this construction may give an improvement of the quality of the weld, it does not provide a solution suitable for mechanized production. The wrapping of the molybdenum foil is even more difficult to mechanize than interposing a platinum foil between molybdenum foil and internal current conductor. Further, the possibility exists that during wrapping the molybdenum foil the edges thereof are damaged, which results in a non-vacuum-tight seal of the foil in the pinch-seal.

Another drawback of the known construction is that the thickness of the current leadthrough at the area of the weld is considerably increased as a result of which cracking occurs more easily during operation of the lamp.

In the lamp according to the invention the weld between the molybdenum foil and the inner current conductor is a molybdenum-to-molybdenum connection. Said welded joints can be made in a reproducible manner, even in a mechanized production process, in spite of the fact that a thin foil (approximately 20 to 40 μ) has to be connected to a comparatively thick current conductor (approximately 0.1 to 3 mm).

The above-mentioned welding problems do not occur in making the butt welded joint between the molybdenum part and the tungsten part of the inner current conductor: in this case two parts of equal or comparable thickness are connected and the sticking of welding electrodes does not occur because the largest heat evolution occurs near the highest contact resistance which in this case is exactly at the place of the butt weld to be made.

The lamp construction according to the invention may be used both in discharge lamps and in incandescent lamps. Since the part of the inner current conductor which in a discharge lamp according to the invention supports the electrode and is therefore present nearest to the starting point of the discharge arc, and since the part of the inner conductor which in an incandescant lamp is connected to the filament and therefore is at the highest temperature during operation is of tungsten, the molybdenum part is not exposed to high temperatures. Therefore, blackening of the wall of the envelope by deposition of molybdenum does not occur in these lamps.

In a preferred embodiment of the lamp according to the invention the butt weld is present within the pinched seal, preferably near the end of the molybdenum foil facing the lamp envelope. The deeper the welded joint is located in the pinched seal, the greater the mechanical rigidity of the lamp.

It will be obvious that the nature of the gas filling, the shape of a filament or of electrodes, and whether or not an auxiliary electrode is present or is not present in discharge lamps is not relevant to the invention.

The invention may be described in greater detail with reference to the following drawings.

Figure 1:
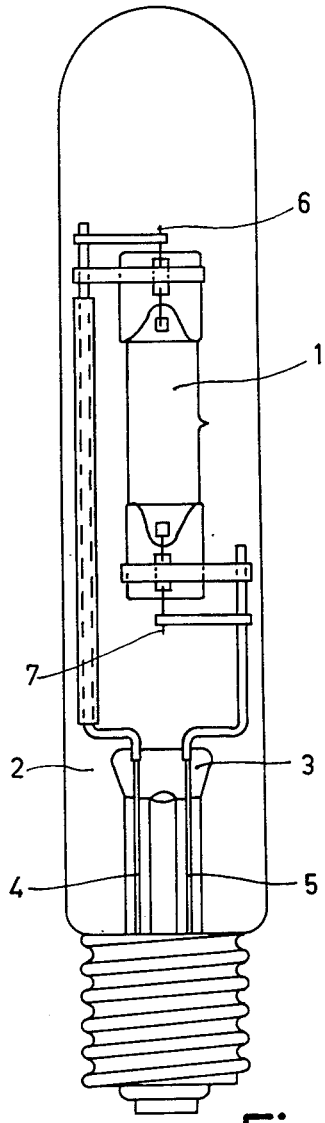
FIG. 1 shows a high pressure discharge lamp.

Reference numeral 1 in FIG. 1 denotes the quartz glass vessel of a high pressure mercury discharge lamp which during operation consumes a power of approximately 400 Watts. The lamp vessel is placed in an outer envelope 2, for example of hard glass, which is evacuated or is filled with an inert gas and has on one side a pinch 3 through which the current supply wires 4 and 5 are led in a vacuum-tight manner. The current supply wires are connected to the outer current conductors 6 and 7 of the lamp vessel and also serves as supporting poles for said vessel.

Figure 2:
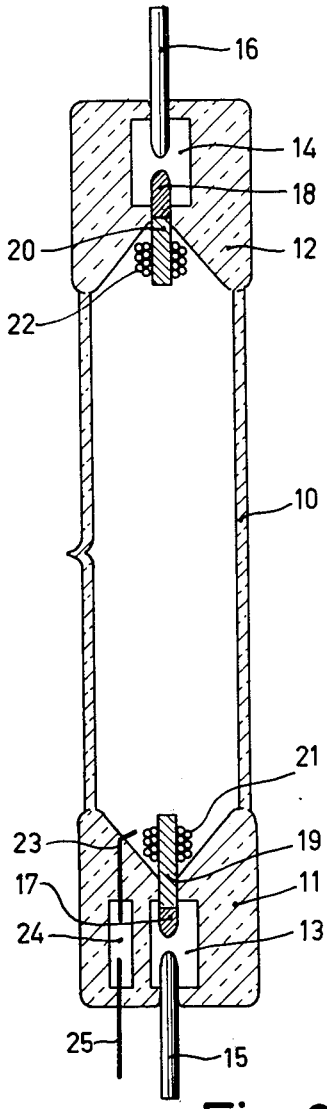
FIG. 2 is a longitudinal sectional view of a discharge vessel.

The quartz glass lamp vessel 10 of FIG. 2 has pinched seals 11 and 12 with molybdenum foils 13 and 14, to which foils are welded on the one hand the outer current conductors 15 and 16 respectively and on the other hand inner current conductors consisting of molybdenum parts 17 and 18, respectively, butt welded to tungsten parts 19 and 20, respectively, which support electrodes 21 and 22, respectively. An auxiliary electrode 23 is also connected to an outer current conductor 25 by means of a molybdenum foil 24.

Figure 3:
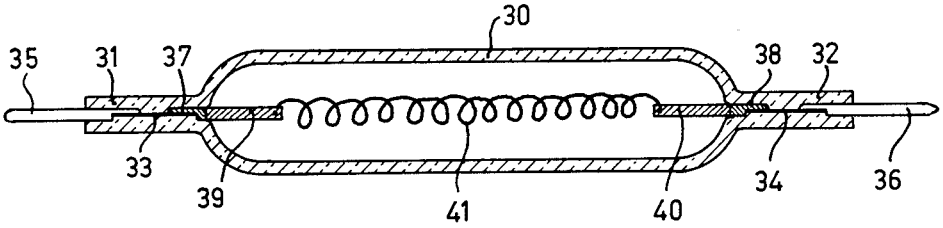
FIG. 3 is a longitudinal sectional view of an incandescent lamp.

The quartz glass lamp vessel shown in FIG. 3 has in its pinched seals 31 and 32 molybdenum foils 33 and 34 to which molybdenum outer current conductors 35 and 36 are welded. The inner current conductors have molybdenum parts 37 and 38, respectively, connected to tungsten parts 39 and 40, respectively, by means of a butt weld. The filament 41 is electrically conductively connected hereto.

What is claimed is:

1. An electric lamp having a quartz glass lamp vessel with gas filling and pinched seal, in which seal a molybdenum foil is incorporated to which an outer current conductor and an inner current conductor are welded, characterized in that the inner current conductor, at least at the area of the welded joint at the molybdenum foil, consists of a molybdenum part which is butt welded to a part which mainly consists of tungsten and extends further in the lamp vessel.

2. An electric lamp as claimed in claim 1, characterized in that the butt weld between the molybdenum part and the tungsten part of the inner current conductor is present within the pinch.

3. An electric lamp as claimed in claim 2, characterized in that the butt weld is present near the end of the molybdenum foil facing the lamp vessel.

* * * * *